United States Patent [19]

Warren et al.

[11] Patent Number: 4,982,802

[45] Date of Patent: Jan. 8, 1991

[54] METHOD FOR STABILIZING A ROTARY DRILL STRING AND DRILL BIT

[75] Inventors: Tommy M. Warren, Coweta; Warren J. Winters, Tulso; J. Ford Brett, Tulsa, all of Okla.

[73] Assignee: Amoco Corporation, Chicago, Ill.

[21] Appl. No.: 441,139

[22] Filed: Nov. 22, 1989

[51] Int. Cl.[5] ..... E21B 17/00; E21B 17/16

[52] U.S. Cl. ..... 175/57; 175/325; 175/399; 175/408

[58] Field of Search ..... 175/55, 319, 343, 376, 175/398, 399, 408, 73, 292, 258, 257, 375, 325, 320, 75, 57; 166/241

[56] References Cited

U.S. PATENT DOCUMENTS

| | | | |
|---|---|---|---|
| 2,841,366 | 7/1958 | Dunn | 175/320 |
| 3,382,938 | 5/1968 | Williams | 175/75 |
| 3,596,721 | 8/1971 | Edgecombe | 175/73 |
| 3,628,616 | 12/1971 | Neilson | 175/375 |
| 3,825,081 | 7/1974 | McMahon | 175/73 |
| 4,220,213 | 9/1980 | Hamilton | 175/325 |
| 4,770,258 | 9/1988 | Falgout | 175/73 |

OTHER PUBLICATIONS

Osman et al., ASME Journal of Engineering for Industry, "Development of Multi-Edge Cutting Tools for BTA Deep-Hole Machining", pp. 474–480 (May, 1976).

*Primary Examiner*—Hoang C. Dang

*Attorney, Agent, or Firm*—Scott H. Brown; Fred E. Hook

[57] ABSTRACT

Apparatus for stabiliing a rotary drill string and drill bit used to drill a borehole in a material, such as a subterranean formation, includes an imbalanced drill collar and a drill bit connected to the drill collar. The imbalanced drill collar creates a drill string imbalance force directed radially outwardly from the center of rotation of the drill collar through a predetermined area on the circumference of the drill collar and urges the predetermined area into contact with the borehole wall as the drill string rotates. The drill bit includes a drilling surface for contacting the material and drilling the borehole in the material, the drilling surface including a cutting zone for cutting the borehole in the material and the bearing zone having a low coefficient of friction relative to the cutting zone. The bearing zone slidingly engages the wall of the borehole as the drill bit rotates and the drill bit is aligned with the drill collar so that the bearing zone and drill string imbalance force are in the same axially-extending radially plane. Preferably, the drill bit is imbalanced to create a drill bit imbalanced force directed radially outwardly from the center of rotation of the drill bit through the bearing zone in the same axially-extending radial plane as the drill string imbalance force.

2 Claims, 5 Drawing Sheets

METHOD FOR STABILIZING A ROTARY DRILL STRING AND DRILL BIT

BACKGROUND OF THE INVENTION

1. Field of the Invention

This invention relates to drill bits used to create boreholes through subterranean formations and, more particularly, to apparatus and method used for stabilizing a drill bit and drill string during subterranean drilling.

2. Setting of the Invention

In the exploration and production of hydrocarbons, a rotating drill bit is used to create a borehole through the Earth's subterranean formations. Users of the drill bits and drill bit manufacturers have found that increased penetration can be achieved by more precisely controlling the weight on bit (WOB) and increasing the rotational speed (RPM) of the drill bit. However, as the RPM has been increased, the drill bit effective life has decreased dramatically because the cutting elements on the drill bit are cracked and occasionally are torn from the drill bit body at the higher RPM's.

Numerous studies have been made to find out what causes such destruction to the cutting elements. The inventors hereof have previously found that a substantial portion of the destructive forces are created by a phenomenon known as "whirl". More specifically, radially-directed, centrifugal imbalance forces exist to some degree on every rotating drill bit and drill string. These forces are created by radial mass imbalances, i.e., mass imbalances across the longitudinal or axial center of the drill bit and drill string, as well as by the dynamic drilling forces which act on the drill bit and drill string. These forces tend to push the drill string and drill bit towards the side of the borehole.

Typically, a drill bit has cutting elements ("cutters") known as gauge cutters which are designed to cut the edge or diameter of the borehole. The centrifugal imbalance forces increase the friction between the cutters contacting the wall of the borehole and the drill bit begins to roll around the wall of the borehole in the opposite direction of the rotation of the drill bit, i.e., normally the drill bit is rotated clockwise and, when the imbalance forces push the cutters into the borehole wall, the drill bit will begin to roll around the borehole in a counterclockwise direction. This phenomenon is commonly called whirl or backwards whirl and is similar to the action of a spirograph.

Once backwards whirl begins, it is self-propagating. The backwards whirling causes the instantaneous center of rotation of the drill bit and drill string to change dynamically as the drill bit backwards whirls around the borehole. The cutting elements travel faster, sideways, and backwards than they do under normal rotation (clockwise) without backwards whirl. Typically, cutters are designed, placed, and supported in a drill bit for cutting while rotating in a predetermined direction, normally clockwise. Since the backwards whirl causes the cutters to contact the borehole in a counterclockwise direction, the forces to which the cutters are exposed are much more likely to damage or destroy the cutters.

Various methods and equipment have been proposed to eliminate or reduce the imbalance forces which initiate backwards whirl, including using dynamically balanced lower drill string assemblies and realigning the cutters to reduce the imbalance forces. As described in U.S. patent application Ser. No. 07/313,126, the inventors of the present invention discovered that backwards whirl can be eliminated and forward whirl induced by creating a low friction bearing zone or pad on the drilling surface of the drill bit. The bearing zone slides on the wall of the borehole and eliminates the friction between the drill bit and the borehole necessary to initiate backwards whirl. The inventors further discovered that a drill bit can be deliberately imbalanced to take advantage of the imbalance forces normally present, i.e., the cutting elements or cutters on the bit can be placed and the mass of the bit and cutters distributed to predetermine the direction of the centrifugal imbalance forces created as the bit rotates and drills. The low friction bearing zone can then be placed so that the predetermined imbalance forces direct and force the bearing zone against the wall of the borehole as the drill bit rotates, thereby preventing backwards whirl by keeping the high friction cutting zone or cutting elements from contacting the borehole wall.

However, even though recent tests conducted by the inventors have shown that the low friction bearing zone can virtually eliminate whirl and greatly increase drill bit life, the dynamics of the drill string itself can cause harmful vibrations as well as contribute to the onset of backwards whirl. Drill string dynamics can, under many circumstances, be so violent as to mitigate the benefits of the low friction bearing zone alone.

A basic concept of the imbalance compensated drill bit disclosed by the inventors in U.S. patent application Ser. No. 07/313,126 is to purposely induce forward whirl in the drill bit so that the drill bit's instantaneous center of rotation or rotational axis does not change with time. If the drill string dynamic forces transferred to the drill bit are sufficient to overcome the force keeping the low friction bearing zone of the drill bit in contact with the borehole wall, the low friction bearing zone will not properly function and backwards whirl may be initiated. The drill bit's cutters will not run true and will be subject to breakage and failure.

Drill collars are commercially available which are intentionally mass imbalanced to induce forward whirl in the drill string. One such drill collar is known as the "wood Pecker" drill collar. These drill collars are sometimes used in attempts to drill straighter boreholes. There is debate within the industry as to the effectiveness of the imbalanced collars for drilling straighter holes, although it is generally agreed that forward whirl is induced by the mass imbalance under normal rotary drilling conditions. There has been no prior disclosure or suggestion of using the imbalanced collars with a drill bit having a low friction bearing zone.

Therefore, there is a need for an apparatus and method which will stabilize both the drill string and drill bit and which will reduce, if not eliminate, backwards whirl of the drill bit and drill string, whether initiated by drill bit imbalance forces or by drill string dynamics.

SUMMARY OF THE INVENTION

The present invention is contemplated to overcome the foregoing deficiencies and meet the above-described needs. For accomplishing this, the present invention provides a novel and improved apparatus and method for stabilizing a rotary drill string and drill bit.

The apparatus for stabilizing a rotary drill string and drill bit used to drill a borehole in a material, such as a subterranean formation, includes a drill bit connectable to the drill string and a drill string imbalancing means connectable to the drill string apart from the drill bit. The drill bit has a drilling surface for contacting the material and drilling the borehole in the material. The drilling surface includes a cutting zone for cutting the borehole in the material and a bearing zone for slidingly engaging the wall of the borehole as the drill bit rotates. The drill string imbalancing means creates a drill string imbalance force which is directed radially outwardly from the rotational axis or center of rotation of the drill string through a predetermined area on the circumference of the drill string. Preferably, the drill string imbalance force is directed radially outwardly in an axially-extending radial plane passing through the bearing zone. In other words, the rotational axis or center of rotation of the drill string and the direction of the drill string imbalance force define a force plane extending radially in one direction from the rotational axis and the bearing zone is positioned so that the force plane passes radially outwardly through the bearing zone.

Preferably, the drill string imbalancing means is a radially imbalanced drill collar and the drill bit is connected to the drill collar.

The method of stabilizing a rotary drill string and drill bit includes: creating a bearing zone in the drilling surface of a drill bit so that the bearing zone slidingly engages the wall of the borehole; creating a drill string imbalance force in the drill string apart from the drill bit; directing the drill string imbalance force radially outwardly from the rotational axis of the drill string; and aligning the drill bit and drill string so that the bearing zone and drill string imbalance force are in the same axially-extending radial plane and the drill string imbalance force urges the bearing zone into contact with the borehole wall as the drill string and drill bit rotate.

Preferably, the method also includes creating a drill bit imbalance force in the drill bit and directing the drill bit imbalance force radially outward through the bearing zone so that the drill bit imbalance force urges the bearing zone into contact with the borehole wall as the drill bit rotates.

It is contemplated that the present invention will make the drill bit insensitive to drill string vibrations by controlling the extent and magnitude of drill string vibrations and by using the drill string dynamic forces together with the drill bit dynamic forces to keep a selected bearing zone of the drill bit in contact with the borehole wall.

It is contemplated that the present invention will reduce drill bit breakage and downtime of the drilling assembly.

It is contemplated that the present invention will allow more accurate drilling of oil and gas wells and result in higher production rates of oil and gas.

It is contemplated that the present invention will mass imbalance the drill string towards the low friction bearing zone on the drill bit so that the primary dynamic drill string force will be predictably and reliably in the direction of the low friction bearing zone.

It is contemplated that the present invention will eliminate or reduce backwards whirl in a drill string and drill bit while inducing forward whirl in the drill string and drill bit.

It is contemplated that the present invention will stabilize the instantaneous center of rotation of the drill string and drill bit.

It is contemplated that the present invention will stabilize the rotational speed of the cutting elements of the drill bit.

It is contemplated that the present invention will prevent or reduce overgauging of the borehole.

BRIEF DESCRIPTION OF THE DRAWINGS

The present invention will be better understood by reference to the examples of the following drawings.

DETAILED DESCRIPTION OF THE PREFERRED EMBODIMENTS

Figure 1:
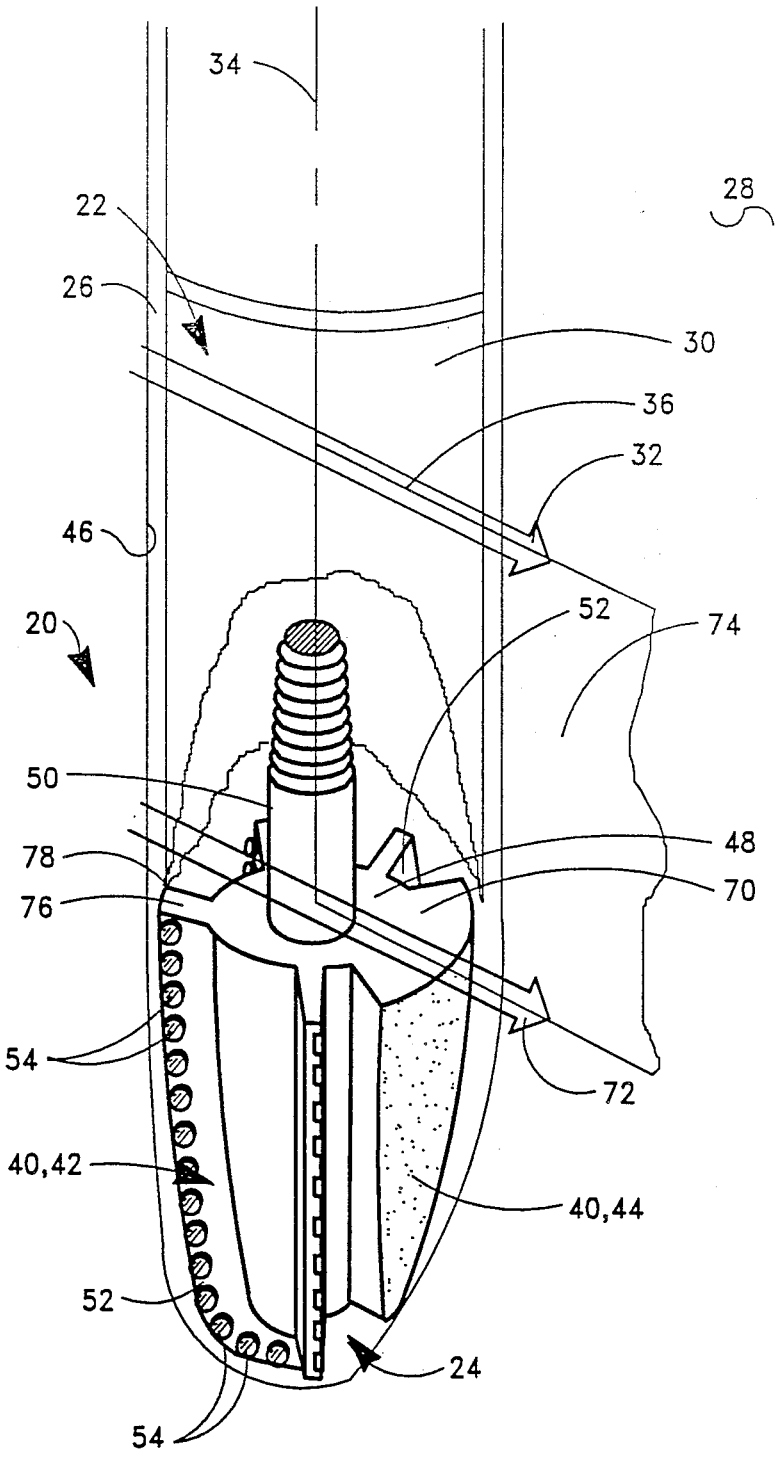
FIG. 1 is a perspective view, partially cut away, of an embodiment of the apparatus for stabilizing a rotary drill string and drill bit of the present invention.

FIGS. 1–6 present embodiments of the apparatus and method, generally designated 20, for stabilizing a rotary drill string 22 and drill bit 24 which are used to drill a borehole 26 in a material 28, such as a subterranean formation, also designated 28. Typically, the apparatus and method 20 will be used when drilling for subterranean fluids such as oil and gas, water, steam, etc. It is contemplated that the apparatus 20 may be used in drilling boreholes 26 through virtually any type of material 28.

Referring to the example of FIG. 1, the apparatus 20 and method of the present invention may be generally described as comprising a drill bit 24 connectable to the drill string 22 and a drill string imbalancing means 30 connectable to the drill string 22 apart from the drill bit 24. The drill string imbalancing means creates a drill string imbalance force 32 which is directed radially outwardly from the rotational axis 34 of the drill string 22 through a predetermined area 36 on the circumference of the drill string 22. The term "rotational axis" is used herein interchangeably and synonymously with the term "instantaneous center of rotation" or "center of rotation", as further discussed below.

The drill bit 24 has a drilling surface 40 which contacts the material or subterranean formation 28 and drills the borehole 26 in the material 28. The drilling surface 40 includes a cutting zone 42 for cutting the borehole 26 in the material 28 and a bearing zone 44 for slidingly engaging the wall 46 of the borehole 26 as the drill bit 24 rotates.

As exemplified in FIG. 1, the drill bit 24 includes a generally cylindrical body 48 having a threaded pin shank 50 for interconnection with a source of rotation, such as a rotating drill string 22, as is well known. The drill bit 24 can be a Stratapax, PDC, diamond matrix, roller cone, or virtually any other known drilling bit design and configuration. In the embodiment of FIG. 1, a plurality of cutting blade members 52 extend from the body 48 and include a plurality of cutting elements 54 mounted thereon in any conventional manner. The blades 52 and cutting elements or cutters 54 define the at least one cutting zone 42.

Figure 2A:
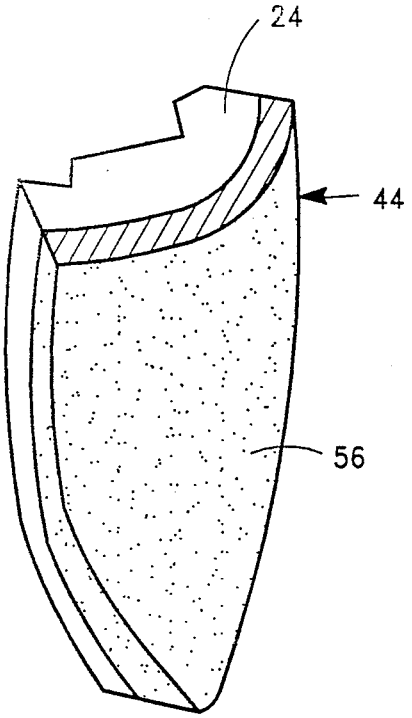
FIGS. 2A, 2B, and 2C perspective views of an embodiment of a bearing zone for a drill bit with different embodiments of wear surfaces thereon.
Figure 2B:
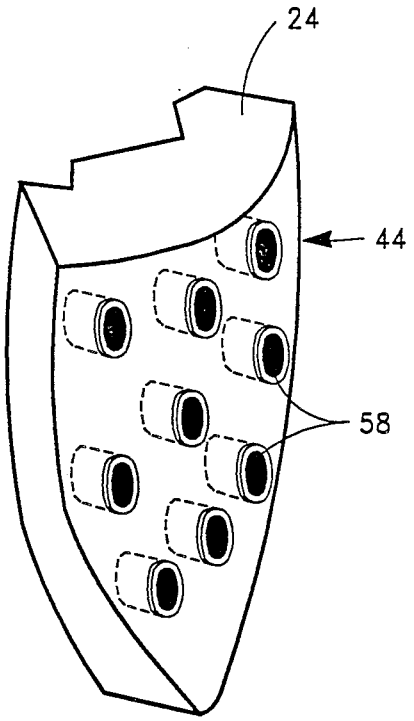
Figure 2C:
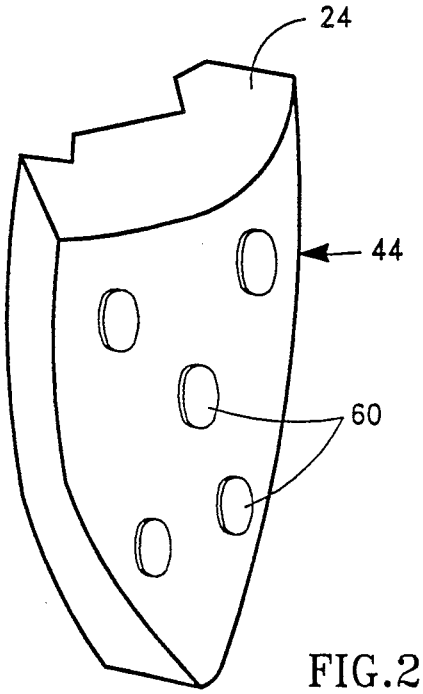
Figure 3:
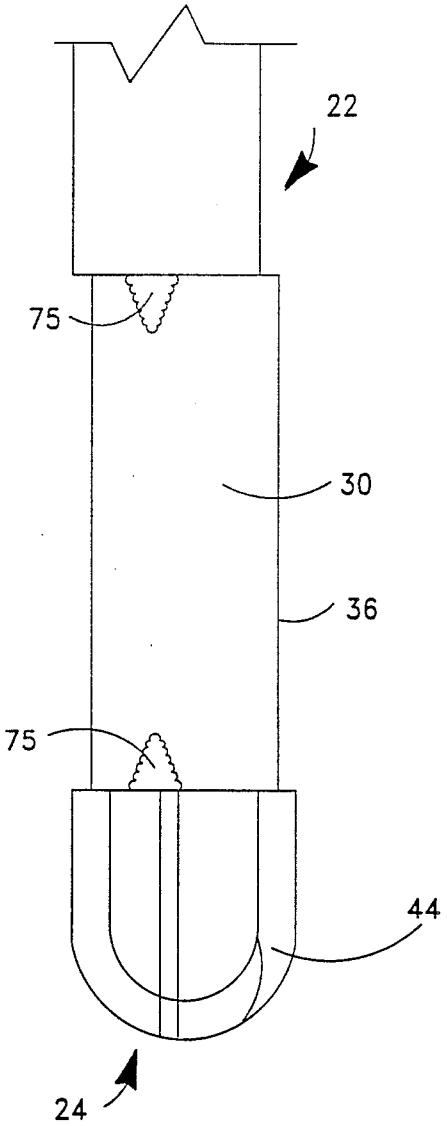
FIG. 3 is a side view of an embodiment of an eccentrically mounted drill string imbalancing means of the present invention.
Figure 4:
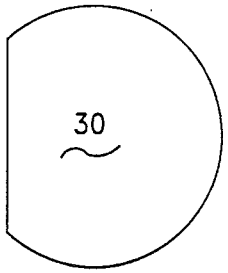
FIG. 4 is a transverse cross-sectional view of another embodiment of the drill string imbalancing means of the present invention.

The bearing zone 44 also extends from the drill bit body 48, and preferably extends the same distance from the geometric center of the drill bit 24 as do the blades 52. Preferably, the bearing zone 44 is at least one relatively smooth, hardened pad area. The bearing zone 44 can, as shown in FIGS. 2A, 2B, and 2C, include a wear coating 56, a plurality of diamond stud inserts 58, and diamond pads 60, etc. The bearing zone 44 should have a low coefficient of friction relative to the cutting zone 42 so that the bearing zone 44 will slide on the borehole wall 46. Further, the bearing zone 44 is preferably of sufficient surface area so that as the bearing zone 44 is forced against the borehole wall 46, the applied force per square inch will be less than the compressive strength of the borehole wall 46 or subterranean material 28; and also low enough to provide acceptably small rates of wear on the pad itself. This preferable requirement is to keep the bearing zone 44 from digging into and crushing the borehole wall 46 which would result in the initiation of the undesired backwards whirling motion. Other features of the cutting zone 42 and bearing zone 44 are further described in previously mentioned U.S. patent application Ser. No. 07/313,126 which is incorporated herein by reference thereto.

The bearing zone 44 can include cutting elements 58 and 60 of different sizes, configurations, depths of cut, and/or rake angle than the cutting elements 54 in the cutting zone 42. Any cutting elements 58 and 60 used should generate less cutting forces than the cutting elements 54 in the cutting zone so the bearing zone 44 will have a relatively low coefficient of friction as compared to the cutting zone 42. The bearing zone 44 may also include one or more cylindrical rollers or caged ball bearings which provide a rolling surface to permit the bearing zone 44 to more easily roll on the borehole wall 46. The bearing zone 44 may extend over as long or as small an area of the drill bit body 48 as desired, the major constraint being that the drill bit should have sufficient cutting elements 54 adequately arranged in the cutting zone 42 for efficient cutting of material 28. For example, the bearing zone 44 can extend across a radially-extending side of the drill bit body 48 downwardly on to the axially-extending bottom face.

Preferably, the drill bit 24 includes drill bit imbalancing means 70 for creating a drill bit imbalance force 72, best exemplified in FIG. 1, directed radially outwardly from the rotational axis 34 of the drill bit 24 through the bearing zone 44. The drill bit imbalancing means 70 is preferably some type of mass imbalance which is created in the drill bit 24 by adding or arranging mass on the drill bit 24. Additionally, the drill bit 24, cutting elements 54, or blades 52 may be formed, sized, or arranged to create the desired drill bit imbalance force 72. In the examples of FIG. 1, the mass 70 supporting the bearing zone 44 provides desired mass imbalance. Also, the forces encountered by the drill bit 24 and cutting elements 54 while drilling may be calculated or modeled and used to contribute to the drill bit imbalance force 72. A more detailed description of the modeling and calculation of the drill bit imbalance force 72 may be found in U.S. patent application Ser. No. 07/313,126, which is incorporated herein by reference thereto. The drill string imbalance force 32 and drill bit imbalance force 72, both individually and collectively, should urge the bearing zone 44 into contact with the borehole wall 46 as the drillstring 22 rotates.

As exemplified in FIG. 1, in the preferred embodiment, the drill string imbalance force 32 is directed radially outwardly in an axially-extending radial plane 74 passing through the bearing zone 44. In other words, the rotational axis 34 of the drillstring 22 and the direction of the drill string imbalance force 32 define a force plane, also designed 74, which extends radially from the rotational axis and the bearing zone 44 should be positioned so that the force plane 74 passes radially outwardly through the bearing zone 44.

In the preferred embodiment, referring to the example of FIG. 1, the drill string imbalancing means 30 is a radially imbalanced drill collar, also designated 30. As previously mentioned, by radially imbalanced is meant that the drill collar 30 (or drill bit 24) is mass imbalanced across its longitudinal or axial center in order to create a radially-directed centrifugal force acting along a predetermined radius. The drill collar 30 or drill string 22 may be imbalanced by any desired method. For example, as exemplified in FIG. 3, the drill collar 30 may be eccentrically connected into the drill string 22. As exemplified in FIG. 3, the threaded pin connections 75 at each axial end of the drill collar 30 are slightly off of the axial center of the drill collar which imbalances the drill collar toward the right side. The drill collar may also be imbalanced by removing mass from one circumferential side of the drill collar 30, i.e., shaving one side of the drill collar 30 flat, as exemplified in FIG. 4. Mass may also be removed from one circumferential side of the drill collar 30 by drilling holes in the drill collar 30 (not illustrated) Another method of imbalancing the drill collar 30 would be to add mass to one circumferential side of the drill collar 30 (not illustrated).

The drill bit 24 is preferably connected directly to the drill string imbalancing means 30 in order to facilitate proper alignment of the drill string imbalance force 32 and the drill bit imbalance force 72. That is, the imbalance forces 32, 72 should both urge the bearing zone 44 into contact with the borehole wall 46 and it is felt this will best be achieved by aligning or directing both imbalance forces 32, 72 through approximately the same area of the bearing zone 44. Typically, the drill bit 24 has a threaded shank 50 which threads into the drill collar 30 and the alignment of the drill bit 24 and drill collar 30 is determined by the point at which the drill bit shoulder 76 contacts the drill collar shoulder 78. In order to properly align the imbalance forces 32, 72, first the predetermined area 36 on the circumference of the drill string 22 or drill collar 30 upon which the drill string imbalance force 32 acts, i.e., the area of the drill collar 30 which is urged towards the borehole wall 46 by the drill string imbalance force 32, is determined. Then, the bearing zone 44 and preferably the precise area of the bearing zone 44 which has been determined to be urged towards the borehole wall 46 by the drill bit imbalance force 72, is aligned with the predetermined area 36 of the drill collar 30. This may be accomplished by threading or screwing the drill bit 24 onto the drill collar 30 and observing the alignment of the bearing zone 44 and the shoulders 76 and 78. If the imbalance forces 32, 72 are not properly aligned, the alignment may be adjusted by adding shims or washers between the drill bit 24 and drill collar 30; by trimming or shaving one of the shoulders 76, 78; or by adding a concentrically sliding sleeve within the drill collar 30 to which the drill bit 24 may be fastened, aligning the imbalance forces 32, 72, and then securing the sliding sleeve within the drill collar 30 by conventional fastening means such as bolts, screws, set screws, etc.

Although it is preferred to connect the drill bit 24 directly to the drill collar 30 in order to facilitate alignment, it is possible to put a stabilizer, roller reamer, reamer stabilizer, or similar device between the drill bit 24 and the imbalanced drill string or drill collar 30 and practice the present invention.

Figure 5:
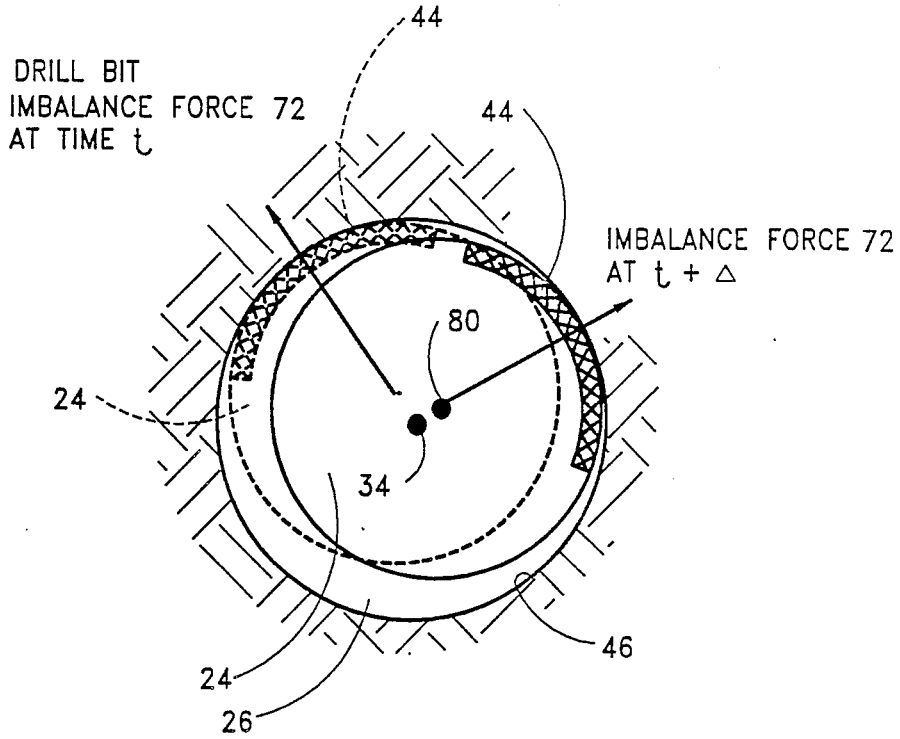
FIG. 5 is a schematic view in transverse cross-section of a drill bit illustrating the drill bit imbalance forces of the present invention.

In operation, the bearing zone 44 prevents backward whirl in the following manner. As exemplified in FIG. 5, a drill bit body 24 is shown rotating within a borehole 26. The drill bit imbalancing means 70 and forces acting on the cutting elements 54 create the drill bit imbalance force 72 that is directed toward the bearing zone 44. Referring to FIG. 5, the drill bit 24 has been rotated to a new position at time $t+\Delta$. Because of the low friction characteristics of the bearing zone 44 and the fact that the drill bit imbalance force 72 forces the bearing zone 44 into contact with the borehole wall 46 as the drill bit 24 rotates, the bearing zone 44 slips or slides along the borehole wall 46 from its position at time t to its position at time $t+\Delta$. The bearing zone 44 should remain in contact with the borehole wall 46 throughout the rotation of the drill bit 24 within the borehole 26. The speed of rotation of the drill bit 24 must be sufficient to create the centrifugal forces, the drill string imbalance force 32 and the drill bit imbalance force 72 needed to urge the bearing zone 44 into contact with the borehole wall 46.

Figure 6:
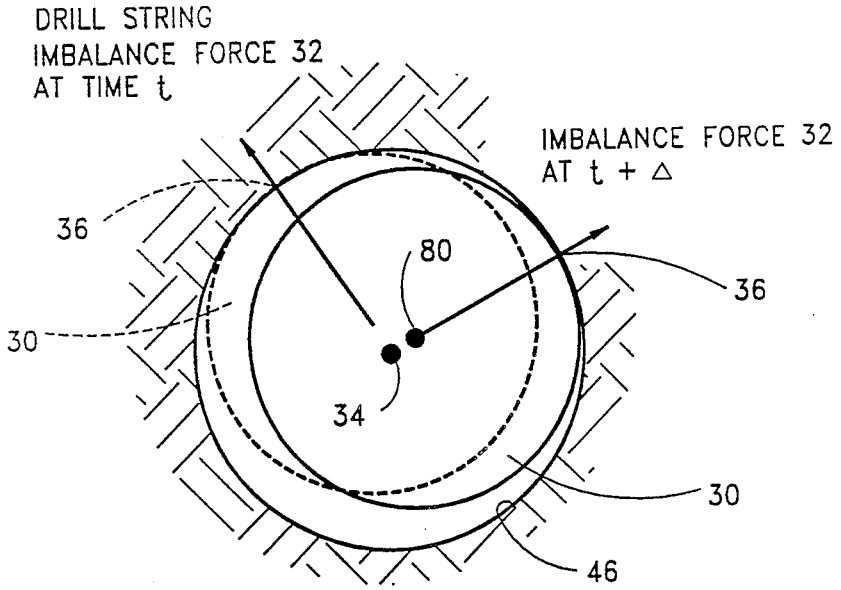
FIG. 6 is a schematic view in transverse cross-section of a drill collar illustrating the drill string imbalance forces of the present invention.

FIG. 6 illustrates the operation of the drill string imbalance means or imbalanced drill collar 30. The drill string imbalance force 32 urges the predetermined area 36 of the circumference of the drill collar 30 towards or into contact with the borehole wall 46 at time t and at time $t+\Delta$. Although the predetermined area 36 is discussed herein and illustrated in FIG. 6 as contacting the borehole wall 46 when subjected to the drill string imbalance force 32, it should be understood that in many, if not most, situations the drill collar 30 and predetermined area 36 will not contact the borehole wall 46 but the predetermined area 36 will be urged or biased towards the borehole wall 46 by the drill string imbalance force 32. The predetermined area 36 remains in contact with the borehole wall 46 throughout the rotation of the drill string 22 and drill collar 30 within the borehole 26. The speed of rotation of the drill string 22, drill collar 30, and drill bit 24 must be sufficient to create the drill string imbalance force and drill bit imbalance force which urge the drill string 22 or drill collar 30 and drill bit bearing zone 44 toward and into contact with the borehole wall 46.

From FIGS. 5 and 6, it should be understood that by aligning the drill string imbalance force 32 (for example, at time t in FIG. 6) with the drill bit imbalance force 72 (for example, at time t in FIG. 5), the drill string imbalance force 32 will augment the drill bit imbalance force 72 in urging the bearing zone 44 into contact with the borehole wall 46 and in overcoming any drill string dynamics which might otherwise negate the drill bit imbalance force 72.

Referring to the example of FIGS. 5 and 6, it should be noted that during normal "non-whirling" rotation or forward whirl of the drill string 22 and drill bit 24, the imbalance forces 32, 72 originate at the rotational axis 34 or instantaneous center of rotation of the drill collar 30 and drill bit 24, which will normally be along the same longitudinal axis. Normally, the center of rotation 34 will not be the geometric center 80 of the drill string 22, drill collar 30, or drill bit 24 since the drill bit 24 and drill string 22 will be in contact with or urged towards the borehole wall 46 (even during forward whirl) and the borehole 46 is usually of larger diameter than the drill bit 24 and drill string 22, as exemplified in FIGS. 5 and 6. Since the bearing zone 44 slides on and should be in continuous contact with the borehole 46 during forward whirl, the center of rotation or the rotational axis 34 of the drill bit 24 is static and normally coincides with the center of the borehole 26 during forward whirl. During backwards whirl, the center of rotation is dynamic, i.e., as the drill bit 24 backward whirls around the borehole 26, the instantaneous center of rotation of the drill bit 24 is at the point of contact between the drill bit 24 and the borehole wall 46 (assuming no slippage at the point of contact), and therefore the center of rotation travels around the borehole 26 with the drill bit 24. During forward whirl, the drill bit 24 will move (or whirl) slowly clockwise with the bearing zone in constant contact with the borehole wall. Since the bearing zone 44 is in continuous contact with the borehole wall 46, the borehole 26 is not overgauged during forward whirl as it can be during backwards whirl.

While presently preferred embodiments of the invention have been described herein for the purposes of disclosure, numerous changes in the construction and arrangement of parts and the performance of steps will suggest themselves to those skilled in the art, which changes are encompassed within the spirit of this invention as defined by the following claims.

What is claimed is:

1. A method of stabilizing a drillstring and a drill bit connected in the drillstring used to drill a borehole in a material, comprising:

(a) providing in a drillstring a drill bit having a mass imbalance so when rotated an imbalance force is directed to an outwardly axially extending radial plane towards a smooth, bearing portion on the drill bit;

(b) providing in the drillstring above the drill bit a tubular member having a structure so when rotated an imbalance force is directed in an axially extending radial plane;

(c) aligning the drill bit and the tubular member so that the imbalance forces of the drill bit and the tubular member are in the same axially-extending radial plane; and (d) rotating the aligned drill bit and tubular member to force the smooth bearing portion of the drill bit into sliding contact with a wall of the borehole and drill the borehole in the material.

2. The method of claim 1 wherein step (c) comprises rotating an upper portion of the drill string at the earth's surface to rotate the aligned drill bit and tubular member.

* * * * *

UNITED STATES PATENT AND TRADEMARK OFFICE

CERTIFICATE OF CORRECTION

PATENT NO. : 4,982,802

DATED : January 8, 1991

INVENTOR(S) : Brett/Warren

It is certified that error appears in the above--identified patent and that said Letters Patent is hereby corrected as shown below:

ON THE TITLE PAGE Item [75] delete "Warren J. Winters".

In the Abstract, first line, "stabiliing" should read --stabilizing--.

Signed and Sealed this

Tenth Day of November, 1992

*Attest:*

DOUGLAS B. COMER

*Attesting Officer*

*Acting Commissioner of Patents and Trademarks*